US008036551B2

(12) United States Patent
Murayama

(10) Patent No.: US 8,036,551 B2
(45) Date of Patent: Oct. 11, 2011

(54) IMAGE FORMING APPARATUS WITH A CORRECTING SECTION

(75) Inventor: Kentaro Murayama, Kasugai (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 394 days.

(21) Appl. No.: 12/188,609

(22) Filed: Aug. 8, 2008

(65) Prior Publication Data

US 2009/0162111 A1 Jun. 25, 2009

(30) Foreign Application Priority Data

Dec. 25, 2007 (JP) ..... 2007-332254

(51) Int. Cl.
*G03G 15/00* (2006.01)
*G03G 15/01* (2006.01)

(52) U.S. Cl. ..... 399/49; 399/301

(58) Field of Classification Search ..... 399/49, 399/301; 347/116
See application file for complete search history.

(56) References Cited

U.S. PATENT DOCUMENTS

| | | | | |
|---|---|---|---|---|
| 5,510,885 | A | 4/1996 | Mori et al. | |
| 5,825,984 | A | 10/1998 | Mori et al. | |
| 5,872,586 | A | 2/1999 | Shio | |
| 6,236,827 | B1 | 5/2001 | Hada | |
| 6,603,495 | B2 * | 8/2003 | Hayakawa | 347/116 |
| 6,714,224 | B2 * | 3/2004 | Yamanaka et al. | 347/116 |
| 7,076,192 | B2 | 7/2006 | Tsuda et al. | |
| 7,627,277 | B2 * | 12/2009 | Maeda | 399/301 |
| 7,630,657 | B2 * | 12/2009 | Ehara et al. | 399/45 |
| 7,664,413 | B2 * | 2/2010 | Kobayashi et al. | 399/49 |
| 7,702,268 | B2 * | 4/2010 | Suzuki | 399/301 |

(Continued)

FOREIGN PATENT DOCUMENTS

JP HEI 07-309037 11/1995

(Continued)

OTHER PUBLICATIONS

Extended European Search Report dated May 4, 2010.

(Continued)

*Primary Examiner* — Robert Beatty
(74) *Attorney, Agent, or Firm* — Scully, Scott, Murphy & Presser, P.C.

(57) ABSTRACT

An image forming apparatus includes an image forming section, a controlling section, a detecting section, and a correcting section. The image forming section forms an image on an object. The controlling section controls the image forming section to form a calibration pattern on the object. The calibration pattern includes a plurality of marks in a first group and a plurality of marks in a second group. The plurality of marks in each of the first group and the second group is arranged in a first direction over a predetermined range. The plurality of marks in each of the first group and the second group includes first marks and second marks. The first mark in the first group corresponds to the second mark in the second group in a second direction different from the first direction in at least part of the predetermined range. The first mark in the second group corresponds to the second mark in the first group in the second direction in at least part of the predetermined range. The detecting section detects the first mark and the second mark formed on the object. The correcting section corrects, based on the detected first mark, a deviation in the first direction of an image forming position at which the image forming section forms an image, and corrects, based on the detected second mark, a deviation in the second direction of the image forming position.

9 Claims, 4 Drawing Sheets

U.S. PATENT DOCUMENTS

| | | | | |
|---|---|---|---|---|
| 7,706,705 | B2 * | 4/2010 | Tomita et al. | 399/49 |
| 7,715,769 | B2 * | 5/2010 | Miyadera | 399/301 |
| 7,734,234 | B2 * | 6/2010 | Ikeda | 399/301 |
| 2003/0214568 | A1 | 11/2003 | Nishikawa et al. | |
| 2007/0059053 | A1 | 3/2007 | Namba | |
| 2008/0069602 | A1 * | 3/2008 | Miyadera | 399/301 |
| 2009/0162110 | A1 * | 6/2009 | Murayama | 399/301 |

FOREIGN PATENT DOCUMENTS

| | | |
|---|---|---|
| JP | HEI 09-204087 | 8/1997 |
| JP | 2000-314997 | 11/2000 |
| JP | 2003-316103 | 11/2003 |
| JP | 2004-220012 | 8/2004 |
| JP | 2005-316190 | 11/2005 |
| JP | 2007-010770 | 1/2007 |
| JP | 2007-232763 | 9/2007 |

OTHER PUBLICATIONS

Chinese Official Action dated Jan. 18, 2011 together with English language translation.

* cited by examiner

IMAGE FORMING APPARATUS WITH A CORRECTING SECTION

CROSS REFERENCE TO RELATED APPLICATIONS

This application claims priority from Japanese Patent Application No. 2007-332254 filed Dec. 25, 2007. The entire content of the priority application is incorporated herein by reference.

TECHNICAL FIELD

The invention relates to an image forming apparatus.

BACKGROUND

Conventionally, so-called tandem-type image forming apparatuses are known. This type of image forming apparatus includes a plurality of photosensitive members for each color (yellow, magenta, cyan, and black, for example) that is arranged in a direction in which a paper conveying belt moves. Images in each color borne on a corresponding photosensitive member are sequentially transferred onto a paper on the belt.

In such a tandem-type image forming apparatuses, if image forming positions on paper for each color are deviated (shifted) from the correct positions, color images with color registration errors are formed undesirably. Hence, one of these image forming apparatuses has a function to correct image forming positions of each color (Japanese Patent Application Publication No. 2007-232763). When performing this correcting function, first the image forming apparatus forms a registration error detection pattern (calibration pattern) on the belt. The registration error detection pattern includes marks in a left group formed along a left end of the belt and marks in a right group formed along a right end of the belt. The both groups have the same configuration where marks in each color are arranged with predetermined spaces along a direction in which the belt moves. The positions of the marks in each group are detected by an optical sensor. Then, amounts of registration errors of respective colors (yellow, magenta, and cyan, for example) relative to a reference color (black in this example) are calculated. A left and right average amount of registration errors are obtained from the amounts of registration errors in the both groups. The image forming positions are corrected by offsetting the amounts of registration errors. In this way, errors in detecting registration errors that occur from meandering of the belt and the like can be reduced, by using the marks in the left and right groups.

SUMMARY

However, in the conventional image forming apparatus, since the image forming positions are deviated not only in one direction (for example, in a main scanning direction) but also in another direction (for example, in a sub scanning direction), it is required to calculate the amounts of the registration errors in both one direction and another direction, and correct the registration errors in both one direction and another direction. However, the rotation condition of the belt, such as rotating speed and a degree of meandering, can be changed as time has passed, since the belt does not necessarily rotate in a stable condition. In other words, if timing when the marks for calculating the registration error in one direction is greatly different from timing when the marks for calculating the registration error in another direction, the rotation condition in which the marks for calculating the registration error in one direction can be formed is greatly different from the rotation condition. As a result, correction accuracy of the image forming position in one direction is different from correction accuracy of the image forming position in another direction. Therefore, it is preferable to form the marks in one direction and another direction at timing as close as possible in order to calculate the amounts of the registration errors in a same rotational condition of the belt.

However, the conventional image forming apparatus forms only the marks for calculating the registration error in the main scanning direction at the left and right ends of the belt as the left and right group described above, when, for example, calculating the amounts of the registration errors in the main scanning direction. On the other hand, the conventional image forming apparatus forms only the marks for calculating the registration error in the sub scanning direction at the left and right ends of the belt as the left and right group described above, when, for example, calculating the amounts of the registration errors in the sub scanning direction. Therefore, since the timing when the marks for calculating the registration error in the main scanning direction is greatly different from the timing when the marks for calculating the registration error in the sub scanning direction, the correction accuracy of the image forming position in the main scanning direction can be different from the correction accuracy of the image forming position in the sub scanning direction due to the difference of the rotation condition of the belt (irregularities of the rotation condition) unless not forming both the marks for calculating the registration error in the main scanning direction and for calculating the registration error in the sub scanning direction at same positions on the belt (for example, over the all circumference). However, if forming both the marks for calculating the registration error in the main scanning direction and for calculating the registration error in the sub scanning direction at the same positions on the belt, it is required to rotate the belt two turns to form both the marks for calculating the registration error in the main scanning direction and for calculating the registration error in the sub scanning direction. Thus, overall length of the marks becomes long, causing time required for calculating the amounts of the registration error of the image forming position long.

In view of the foregoing, it is an object of the invention to provide an image forming apparatus that is capable of shortening the overall length of the calibration pattern and also suppressing the degradation of accuracy in detecting registration errors by preventing the number of marks arranged in the moving direction from decreasing.

In order to attain the above and other objects, the invention provides an image forming apparatus including an image forming section, a controlling section, a detecting section, and a correcting section. The image forming section forms an image on an object. The controlling section controls the image forming section to form a calibration pattern on the object. The calibration pattern includes a plurality of marks in a first group and a plurality of marks in a second group. The plurality of marks in each of the first group and the second group is arranged in a first direction over a predetermined range. The plurality of marks in each of the first group and the second group includes first marks and second marks. The first mark in the first group corresponds to the second mark in the second group in a second direction different from the first direction in at least part of the predetermined range. The first mark in the second group corresponds to the second mark in the first group in the second direction in at least part of the predetermined range. The detecting section detects the first mark and the second mark formed on the object. The correcting section corrects, based on the detected first mark, a deviation in the first direction of an image forming position at which the image forming section forms an image, and corrects, based on the detected second mark, a deviation in the second direction of the image forming position.

BRIEF DESCRIPTION OF THE DRAWINGS

Embodiments in accordance with the invention will be described in detail with reference to the following figures wherein.

DETAILED DESCRIPTION

An image forming apparatus according to some aspects of the invention will be described while referring to FIGS. 1 through 5. The image forming apparatus of the embodiment is applied to a printer 1.

Overall Configuration of Printer

Figure 1:
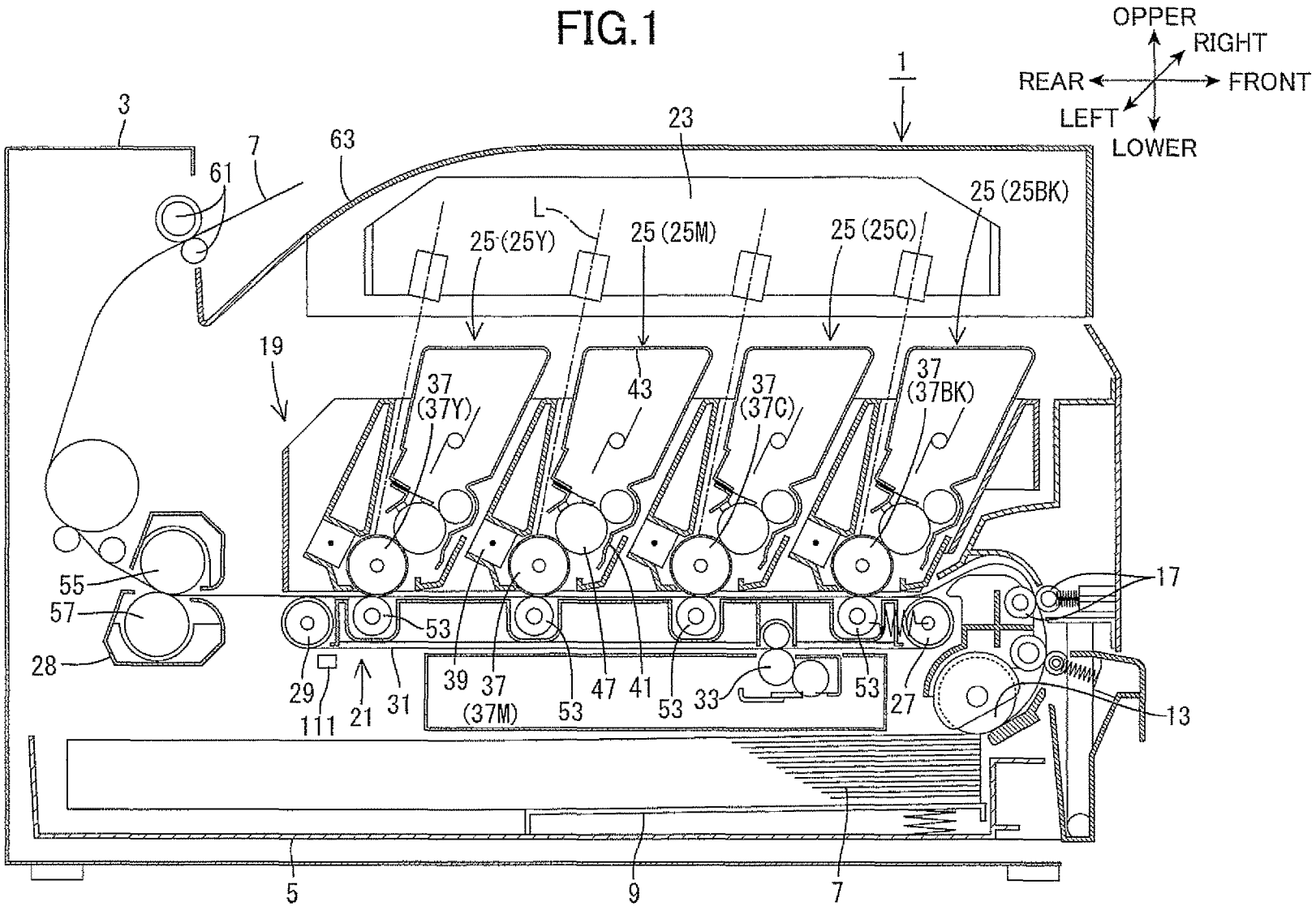
FIG. 1 is a vertical cross-sectional view showing the overall configuration of a printer according to an embodiment of the invention.

FIG. 1 is a vertical cross-sectional view showing the overall configuration of the printer 1. In the following description, the expressions "front", "rear", "upper", "lower", "right", and "left" are used to define the various parts when the printer 1 is disposed in an orientation in which it is intended to be used. As shown in FIG. 1, the right side of FIG. 1 is referred to as the "front" of the printer 1, whereas the left side of FIG. 1 is referred to as the "rear" of the printer 1. Further, the left side when viewed from the front of the printer 1 is referred to as the "left" side of the printer 1, whereas the right side when viewed from the front of the printer 1 is referred to as the "right" side of the printer 1.

As shown in FIG. 1, the printer 1 is a direct-transfer tandem type color laser printer. The printer 1 has a casing 3 for accommodating and supporting other components therein. A top part of the casing 3 is formed as a discharge tray 63. A sheet supplying tray 5 is provided at the bottom of the casing 3. A plurality of recording mediums 7 (sheet-like mediums such as paper sheets, for example) is stacked in the sheet supplying tray 5.

A pressing plate 9 is provided on the sheet supplying tray 5 for urging the recording mediums 7 toward a pickup roller 13. Rotation of the pickup roller 13 picks up one sheet of the recording mediums 7 to convey the sheet of the recording medium 7 to registration rollers 17. The registration rollers 17 corrects obliqueness of the recording medium 7, and then sends off the recording medium 7 to a belt unit 21 at predetermined timing.

An image forming section 19 includes a scanner section 23, a process section 25, a fixing unit 28, and the like.

The belt unit 21 includes a pair of support rollers 27 and 29 (front side support roller 27 and rear side support roller 29) and an endless belt 31 looped around the pair of support rollers 27 and 29. The rear side support roller 29 is connected to a driving source (not shown) and is rotatably driven to cause the belt 31 to move circularly counterclockwise in FIG. 1, thereby conveying the recording medium 7 placed on the belt 31 to the rear.

A cleaning roller 33 is provided underneath the belt unit 21 for removing toner adhered to the belt 31 (including toner of a calibration pattern 131 described later), paper dusts, and the like.

The scanner section 23 includes four laser emitting sections (not shown) each of which is controlled on and off in accordance with image data in each color. The scanner section 23 irradiates laser light L emitted from each laser emitting section on the surfaces of respective photosensitive drums 37 for each color at high speed scanning.

Four units of the process section 25 are provided for respective colors of black, cyan, magenta, and yellow, for example. Each process section 25 has identical configuration except the color of toner or the like. In the following descriptions, reference signs are added with suffixes of BK (black), C (cyan), M (magenta), and Y (yellow) when the colors need to be distinguished. Otherwise, the suffixes are omitted.

Each process section 25 includes the photosensitive drum 37, a charger 39, a developing cartridge 41, and the like. The developing cartridge 41 has a toner accommodating chamber 43, a developing roller 47, and the like. Four transfer rollers 53 are provided below respective ones of the photosensitive drums 37 with the belt 31 therebetween. Toner accommodated in the toner accommodating chamber 43 is supplied to the developing roller 47.

The surface of the photosensitive drum 37 is uniformly charged to positive polarity by the charger 39. Thereafter, the surface of the photosensitive drum 37 is exposed to laser light L emitted from the scanner section 23. This way, the surface of the photosensitive drum 37 is formed with an electrostatic latent image corresponding to an image in each color to be formed on the recording medium 7.

Then, toner borne on the developing roller 47 is supplied to the electrostatic latent image formed on the surface of the photosensitive drum 37, allowing the electrostatic latent image to become a visible toner image in each color.

Thereafter, when the recording medium 7, which is conveyed by the belt 31, passes each transfer position between the photosensitive drum 37 and the transfer roller 53, the toner image on the surface of each photosensitive drum 37 is sequentially transferred onto the recording medium 7 due to a negative-polarity transfer bias applied to the transfer roller 53. In this way, the recording medium 7 on which the toner image has been transferred is conveyed to the fixing unit 28.

The fixing unit 28 includes a heat roller 55 and a pressure roller 57. The heat roller 55, in cooperation with the pressure roller 57, conveys and heats the recording medium 7 bearing the toner image, thereby thermally fixing the toner image on the recording medium 7. Then, discharge rollers 61 discharge the recording medium 7 with the thermally-fixed toner image onto the discharge tray 63.

Electrical Configuration of Printer

Figure 2:
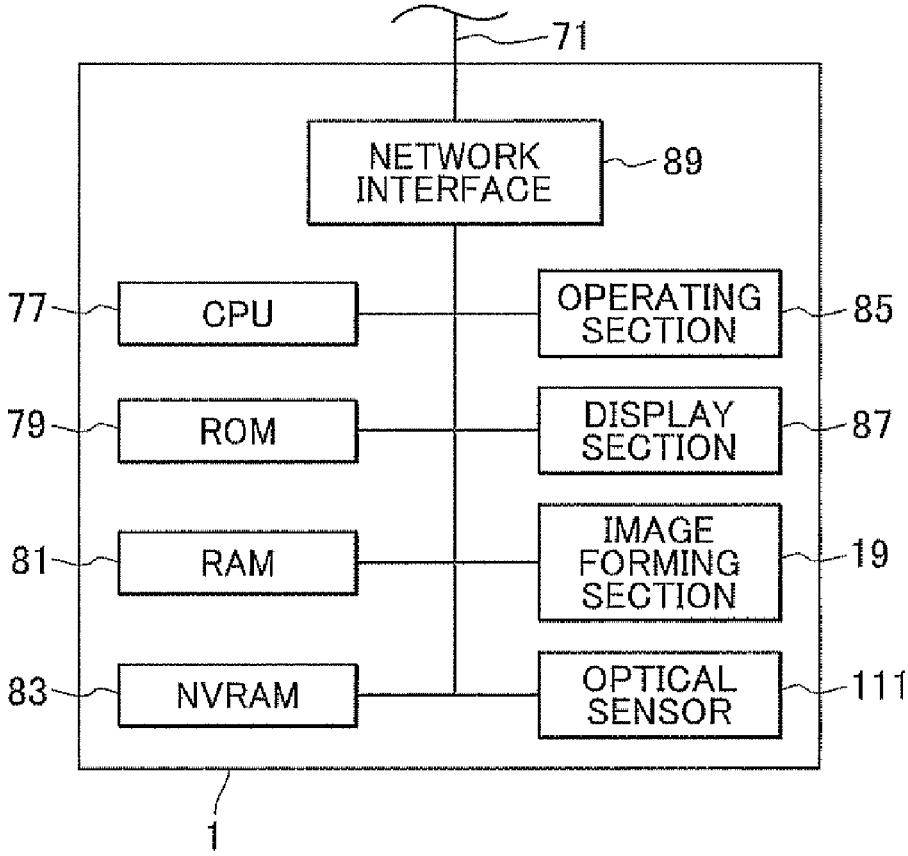
FIG. 2 is a block diagram showing the electrical configuration of the printer of FIG. 1.

FIG. 2 is a block diagram showing the electrical configuration of the printer 1. The printer 1 has a CPU 77, a ROM 79, a RAM 81, an NVRAM 83, an operating section 85, a display section 87, the image forming section 19 described above, a network interface 89, an optical sensor 111, and the like.

The ROM 79 stores various programs for controlling operations of the printer 1. The CPU 77 reads out the programs from the RON 79, executes processing in accordance with the programs, and stores the processing results in the RAM 81 or the NVRAM 83, thereby controls the operations of the printer 1.

The operating section 85 includes a plurality of buttons. The operating section 85 is capable of inputting various operations performed by a user, such as an instruction of print start. The display section 87 includes a liquid crystal display (LCD) and a lamp. The display section 87 is capable of displaying various setting screens, operating conditions, and the like. The network interface 89 is connected to an external computer (not shown) or the like via a communication line 71, and enables data communications between the printer 1 and the external computer or the like.

Configuration for Registration Error Correcting Process

In the printer 1 capable of forming a color image, if image forming positions (transfer positions) of each color on the recording medium 7 are shifted (deviated) from the correct positions, a color image with color registration errors is formed. Hence, it is important to align image forming positions of each color. A registration error correcting process is a process for correcting the above-described color registration errors.

In the registration error correcting process, the CPU 77 of the printer 1 reads data of the calibration pattern 131 (registration pattern) out of the NVRAM 83, for example, and provides the data to the image forming section 19 as image data. At this time, the CPU 77 functions as a controlling section. The image forming section 19 forms the calibration pattern 131 on a surface of the belt 31. The CPU 77 then controls the optical sensor 111 to detect a deviation amount of the calibration pattern 131 based on a level of received light, and corrects laser scanning positions by offsetting the deviation amount. Here, the laser scanning positions are positions on each photosensitive drum 37 at which the scanner section 23 irradiates laser light for each color. The laser scanning positions can be changed by changing timing at which the laser light is emitted in the scanner section 23, for example.

1. Optical Sensor

Figure 3:
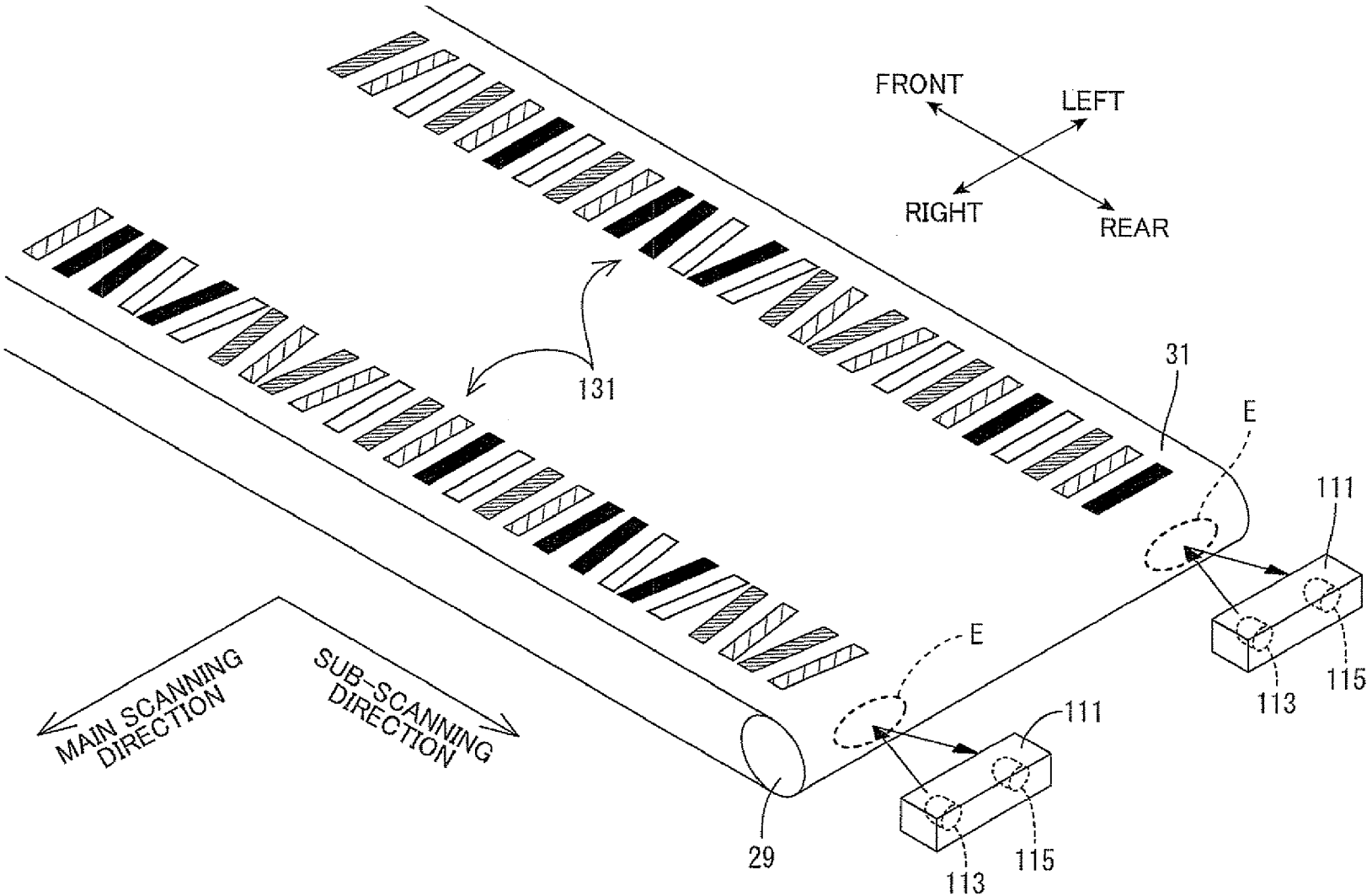
FIG. 3 is a perspective view of optical sensors and a belt provided in the printer of FIG. 1.

As shown in FIG. 3, one or a plurality of optical sensors 111 (two in the present embodiment) is provided at the rear lower side of the belt 31 (see FIG. 1). In the present embodiment, the two optical sensors 111 are arranged in the left-right direction. Each optical sensor 111 is a reflection type sensor having a light emitting element 113 (an LED, for example) and a light receiving element 115 (a photo transistor, for example). More specifically, the light emitting element 113 irradiates light on the surface of the belt 31 from a direction slanted to the surface, and the light receiving element 115 receives light reflected on the surface of the belt 31. The light emitted from the light emitting element 113 forms a spot region on the surface of the belt 31. The spot region is a detection region E of the optical sensor 111.

Figure 4:
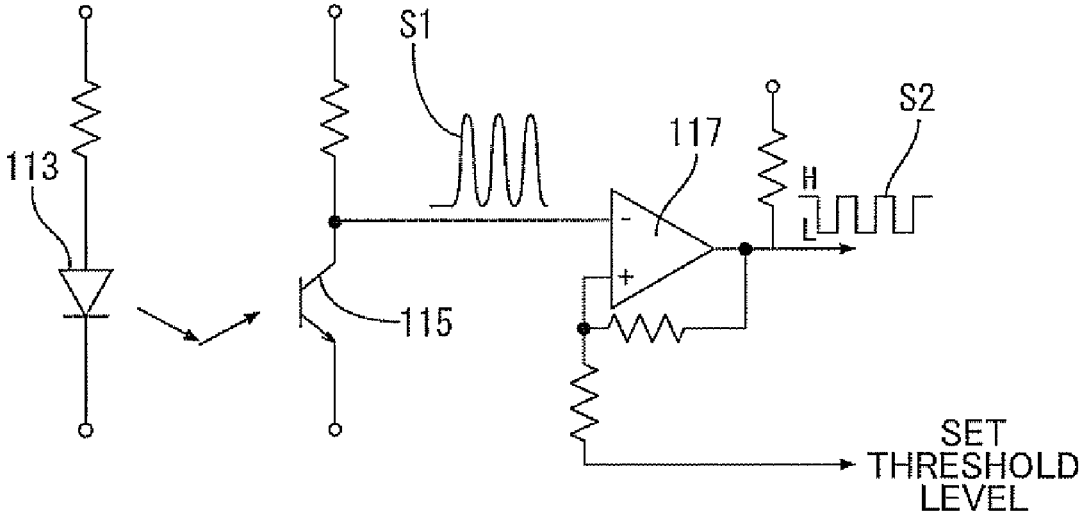
FIG. 4 is a circuit diagram of each of the optical sensors shown in FIG. 3.

FIG. 4 is a circuit diagram of each of the optical sensors 111. A received light signal S1 becomes lower as a level of light amount received by the light receiving element 115 is higher. The other way around, the received light signal S1 becomes higher as the level of light amount received by the light receiving element 115 is lower. The received light signal S1 is inputted into a hysteresis comparator 117. The hysteresis comparator 117 compares the level of the received light signal S1 with detection threshold values TH1 and TH2, and outputs a binary signal S2 that is inverted in accordance with the comparison results.

2. Calibration Pattern of the Present Embodiment

Figure 5:
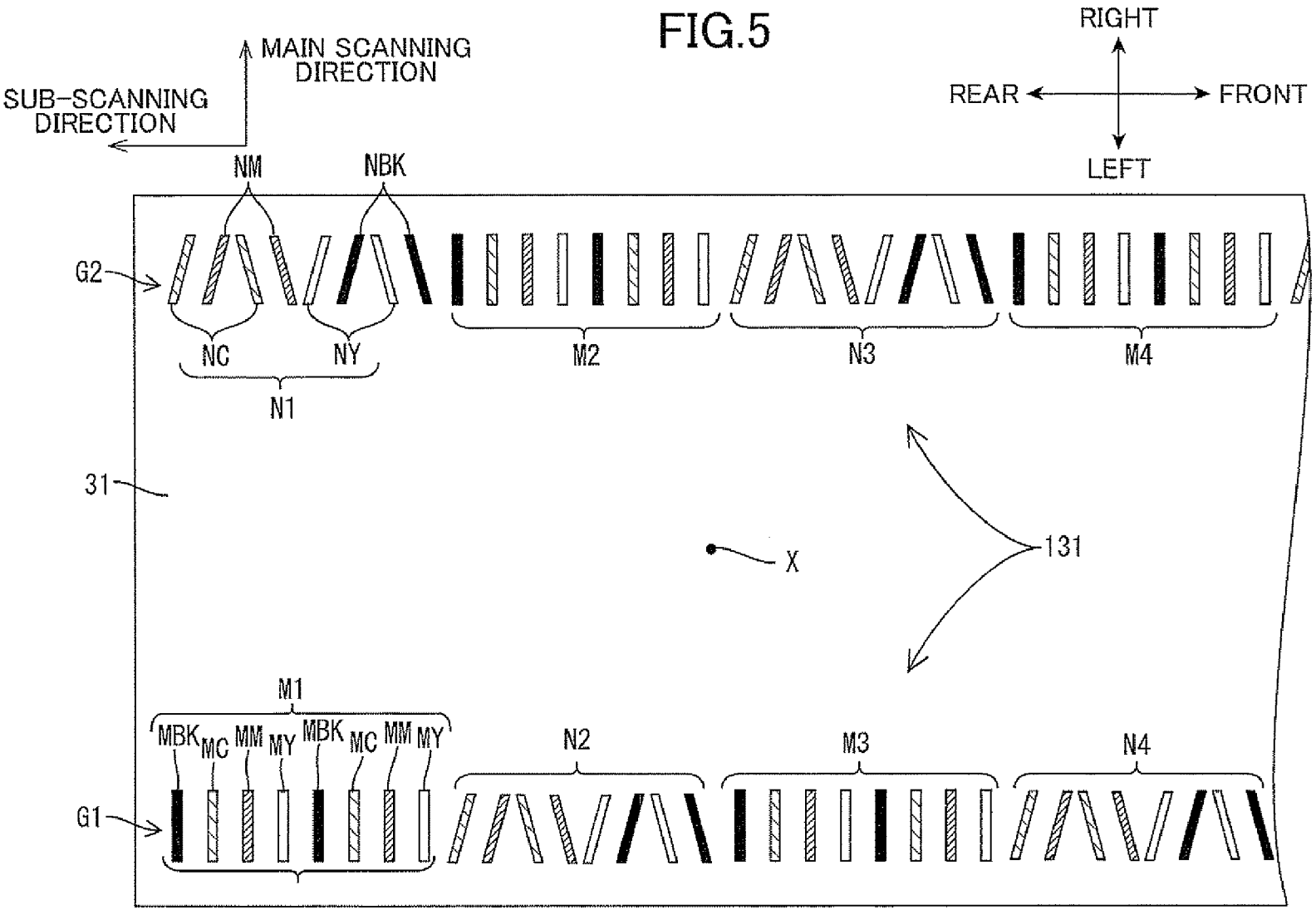
FIG. 5 is an explanatory diagram showing a calibration pattern formed on the belt according to the embodiment.

FIG. 5 is an explanatory diagram showing the calibration pattern 131 according to the present embodiment. The calibration pattern 131 includes a plurality of marks in a first group G1 formed along the left end of the belt 31 and a plurality of marks in a second group G2 formed along the right end of the belt 31. Each of the groups G1 and G2 includes a plurality of sub-scanning direction marks M and a plurality of main scanning direction marks N.

Sub-Scanning Direction Marks

The sub-scanning direction marks M are marks for detecting errors (deviations) of image forming positions in a sub-scanning direction (the direction in which the recording medium 7 is moved by the belt 31). As shown in FIG. 5, the sub-scanning direction marks M have rectangular shapes elongated in the main scanning direction, and are single-color marks in each color of black (MBK), cyan (MC), magenta (MM), and yellow (MY). In the present embodiment, one unit of sub-scanning direction marks M includes a black mark (MSK), a cyan mark (MC), a magenta mark (MM), and a yellow mark (MY), which are repeatedly formed in this order for a predetermined times (two times in the present embodiment) in the sub-scanning direction. The calibration pattern 131 includes a plurality of units of sub-scanning direction marks M (M1, M2, M3, . . . ).

Main Scanning Direction Marks

The main scanning direction marks N are marks for detecting errors (deviations) of image forming positions in a main scanning direction (the direction perpendicular to the moving direction of the recording medium 7). As shown in FIG. 5, the main scanning direction marks N have elongated parallelogram shapes that are slanted with respect to the sub-scanning direction. The main scanning direction marks N include pairs of single-color marks, which are slanted toward the opposite directions, in each color of black (NBK), cyan (NC), magenta (NM), and yellow (NY). Errors (deviations) of the image forming positions in the main scanning direction changes a mark distance between the pair of single-color marks, the distance being obtained based on the binary signal S2 sent from the optical sensor 111. Hence, the errors (deviations) of the image forming positions for each color can be detected based on an amount of change in the mark distance.

In the present embodiment, one unit of main scanning direction marks N includes a pair of black marks (NBK), a pair of cyan marks (NC), a pair of magenta marks (NM), and a pair of yellow marks (NY) The calibration pattern 131 includes a plurality of units of main scanning direction marks N (N1, N2, N3, . . . ). Note that one unit of main scanning direction marks N may include a plurality of pairs of black marks (NBK), a plurality of pairs of cyan marks (NC) a plurality of pairs of magenta marks (NM), and a plurality of pairs of yellow marks (NY).

Arrangement of Sub-Scanning Direction Marks and Main Scanning Direction Marks As shown in FIG. 5, each of the first group G1 and the second group G2 includes the same number of units of the sub-scanning direction marks M and the main scanning direction marks N. Further, units of the sub-scanning direction marks M and units of the main scanning direction marks N belonging to different groups G1 and G2 are formed at the same positions in the sub-scanning direction. For example, a unit of the sub-scanning direction marks M1 in the first group G1 and a unit of the main scanning direction marks N1 in the second group G2 are formed at the same position in the sub-scanning direction (i.e., arranged in the main scanning direction). Similarly, a unit of the main scanning direction marks N2 in the first group G1 and a unit of the sub-scanning direction marks M2 in the second group G2 are formed at the same position in the sub-scanning direction (i.e., arranged in the main scanning direction).

In addition, in each of the first group G1 and the second group G2, units of the sub-scanning direction marks M and units of the main scanning direction marks N are arranged alternately in the sub-scanning direction. Each of the first group G1 and the second group G2 includes the same number of units of the sub-scanning direction marks M and the main scanning direction marks N. All of the sub-scanning direction marks M in the groups G1 and G2 are arranged at equal intervals in the sub-scanning direction. Further, all of the main scanning direction marks N in the groups G1 and G2 are arranged at equal intervals in the sub-scanning direction, with respect to the center positions of the marks. More specifically, all of the main scanning direction marks N in the groups G1 and G2 are arranged such that the center points of the main scanning direction marks N are arranged at equal intervals in the sub-scanning direction.

With the above-described configuration of the calibration pattern 131, the average position (position of center of gravity) of all units of the sub-scanning direction marks M included in the groups G1 and G2 in the sub-scanning direction and in the main scanning direction is identical to the average position (position of center of gravity) of all units of the main scanning direction marks N included in the groups G1 and G2 in the sub-scanning direction and in the main scanning direction. For example, if each of the groups G1 and G2 includes two units of the sub-scanning direction marks M and two units of the main scanning direction marks N, the above-described average position is a point X shown in FIG. 5.

In the present embodiment, a region on the belt 31 where all units of the sub-scanning direction marks M in the groups G1 and G2 are formed has a length in the sub-scanning direction that is equal to or longer than an entire circumferential length of the belt 31 since the sub-scanning direction marks M are removed by the cleaning roller 33. Similarly, a region on the belt 31 where all units of the main scanning direction marks N in the groups G1 and G2 are formed has a length in the sub-scanning direction that is equal to or longer than the entire circumferential length of the belt 31. This arrangement can suppress variations in accuracy in detecting deviations (shifts) of image forming positions due to cyclic fluctuations of the belt 31.

As shown in FIG. 5, in the calibration pattern 131, the sub-scanning direction marks M and the main scanning direction marks N having the same color and belonging to different groups G1 and G2 are arranged in different positions in the sub-scanning direction. More specifically, a mark in the first group G1 and a mark in the second group G2 aligned in the main scanning direction (located at the same position in the sub-scanning direction) have different colors. For example, one of a pair of cyan marks NC in the second group G2 is arranged at the right side of a black mark MBK (the rearmost mark) in the first group G1. Similarly, another one of the pair of cyan marks NC in the second group G2 is arranged at the right side of a magenta mark MM (the third mark from the rearmost) in the first group G1.

Contents of Registration Error Correcting Process

The CPU 77 executes a registration error correcting process when a color registration error correcting timing comes. The color registration error correcting timing is, for example, an elapsed time since the previous registration error correcting process reaches a predetermined value, the number of recording mediums on which images are formed reaches a predetermined number, or the like.

The CPU 77 forms the calibration pattern 131 on the belt 31 and acquires an array of the binary signals S2 from the optical sensor 111. The CPU 77 executes the following process separately on pulse waveforms for the units of the sub-scanning direction marks M and on pulse waveforms for the units of the main scanning direction marks N. Note that whether each pulse waveform corresponds to the units of the sub-scanning direction marks M or the units of the main scanning direction marks N, and which color each pulse waveform corresponds to can be known by associating an order of each pulse waveform from the beginning with an arrangement order of the sub-scanning direction marks M and the main scanning direction marks N in the calibration pattern 131, for example.

The CPU 77 obtains relative distances on the belt 31 for marks MC, MM, and MY in non-black colors (adjustment colors) relative to a black mark MBK (reference color), based on the pulse waveforms corresponding to the units of the sub-scanning direction marks M. More specifically, the CPU 77 obtains mean timing (average timing) between a rising edge timing and a trailing edge timing of each pulse waveform corresponding to each single-color mark MBK, MC, MM, and MY, as detection timing of each single-color mark MBK, MC, MM, and MY. Then, the CPU 77 calculates the relative distances based on differences in detection timing of each adjustment color mark MC, MM, and MY relative to the black mark MBK.

A reference distance is defined as a relative distance of one adjustment color relative to the reference color when an image forming position of the reference color matches an image forming position of the one adjustment color in the sub-scanning direction. If the relative distance is different from the reference distance, the CPU 77 determines the difference as a deviation amount of the image forming position in the sub-scanning direction of one adjustment color relative to the reference color, and stores the deviation amount in the NVRAM 83 as deviation amount data. When the CPU 77 performs subsequent image forming operations, the CPU 77 corrects image forming positions in the sub-scanning direction by offsetting the deviation amount based on the deviation amount data. In the present embodiment, the CPU 77 obtains the deviation amounts for all units of the sub-scanning direction marks M, and determines an average value of the deviation amounts for all the units as the deviation amount of the image forming position in the sub-scanning direction. Thus, one deviation amount is obtained for each of the adjustment colors (cyan, magenta, and yellow).

Further, the CPU 77 obtains an inter-mark distance (distance between marks) of each pair of marks NBK, NC, NM, and NY, based on the pulse waveform corresponding to the units of the main scanning direction marks N. The inter-mark distance varies in accordance with a deviation amount of an image forming position in the main scanning direction. The CPU 77 calculates difference in the inter-mark distance between the black mark NBK and each adjustment color mark NC, NM, and NY for each unit of main scanning direction marks N, and obtains an average value of the differences of all the units of the main scanning direction marks N. The CPU 77 determines the average value as a deviation amount of the image forming position in the main scanning direction of each adjustment color relative to the reference color, and stores the deviation amount in the NVRAM 83 as deviation amount data. Thus, one deviation amount is obtained for each of the adjustment colors (cyan, magenta, and yellow). When the CPU 77 performs subsequent image forming operations, the CPU 77 corrects image forming positions in the main scanning direction by offsetting the deviation amount based on the deviation amount data.

Effects of the Present Embodiment (1) As described above, in the calibration pattern 131 of the present embodiment, the units of the sub-scanning direction marks M are arranged over an entire circumferential length of the belt 31, and at the same time, the units of the main scanning direction marks N are arranged over the entire circumferential length of the belt 31, in order to suppress variations in accuracy in detecting deviations of image forming positions due to cyclic fluctuations of the belt 31.

Here, a conventional image forming apparatus is configured in such a manner that, first, units of the sub-scanning direction marks M are formed on the left and right ends of the belt 31, and then units of the main scanning direction marks N are formed on the left and right ends of the belt 31. In order to form marks over an entire circumferential length of the belt 31 for both of the units of the sub-scanning direction marks M and the units of the main scanning direction marks N with this configuration, the belt 31 needs to be circularly moved at least twice. Hence, the overall length of the calibration pattern becomes twice as the circumferential length of the belt 31.

In contrast, according to the present embodiment, in the calibration pattern 131, the units of the sub-scanning direction marks M and the units of the main scanning direction marks N in different groups G1 and G2 are arranged at the same positions in the sub-scanning direction. Hence, if the calibration pattern 131 has a length of one circumferential length of the belt 31, the units of the sub-scanning direction marks M and the units of the main scanning direction marks N can be formed over an entire circumference of the belt 31 during one circular movement (one rotation) of the belt 31, and deviation amounts (amounts of registration errors) in each of the sub-scanning direction and the main scanning direction can be detected over an entire circumference of the belt 31. Thus, in comparison with the conventional image forming apparatus, degradation of accuracy in detecting registration errors (deviation amounts) can be suppressed by preventing the number of the sub-scanning and main scanning direction marks arranged in the sub-scanning direction from decreasing, while suppressing that the overall length of the calibration pattern becomes long. Further, because the units of the sub-scanning direction marks M and the units of the main scanning direction marks N in different groups G1 and G2 are arranged at the same positions in the sub-scanning direction, shortening of the calibration pattern 131 and suppressing of degradation in detection accuracy can be achieved even more efficiently.

Here, it is preferable that the sub-scanning direction marks and the main scanning direction marks are formed at timing as close as possible, and that deviation amounts in both the sub-scanning direction and the main scanning direction are detected under a condition where the rotation condition of the belt 31 is similar (where the moving speed etc. of the belt is similar). However, in the above-described conventional image forming apparatus, timing of forming the sub-scanning direction marks and timing of forming the main scanning direction marks are largely different. As a result, correction accuracy of image forming positions in the sub-scanning direction and the main scanning direction may have a large difference. In contrast, with the configuration of the present embodiment, the units of the sub-scanning direction marks M and the units of the main scanning direction marks N in different groups G1 and G2 are arranged at the same positions in the sub-scanning direction. Hence, in comparison with the above-described conventional image forming apparatus, the difference in correction accuracy of image forming positions in the sub-scanning direction and the main scanning direction can be suppressed.

(2) In each of the groups G1 and G2 in the calibration pattern 131, the units of the sub-scanning direction marks M and the units of the main scanning direction marks N are arranged alternately in the sub-scanning direction. In other words, in each of the groups G1 and G2, a predetermined number (eight in the present embodiment) of the sub-scanning direction marks M and the same number (eight in the present embodiment) of the main scanning direction marks N are arranged alternately. With this arrangement, arrangement positions and arrangement intervals of the sub-scanning direction marks M on the belt 31 can be matched to arrangement positions and arrangement intervals of the main scanning direction marks N. Hence, in detecting registration errors in both the sub-scanning direction and the main scanning direction, effects of rotation condition of the belt 31 (variation in moving amount of the belt 31, or fluctuation in moving speed of the belt 31) and the like can be suppressed effectively.

(3) Further, in the calibration pattern 131, each of the groups G1 and G2 includes the same number of the units of the sub-scanning direction marks M and the units of the main scanning direction marks N. In other words, each of the groups G1 and G2 includes the same number of the sub-scanning direction marks M and the main scanning direction marks N. With this arrangement, deviation amounts of image forming positions in both the sub-scanning direction and the main scanning direction can be detected uniformly.

Further, since the sub-scanning direction marks M in the groups G1 and G2 are arranged at equal intervals in the sub-scanning direction, deviation amounts of image forming positions in the sub-scanning direction at each position on the belt 31 can be detected uniformly. In addition, since the main scanning direction marks N in the groups G1 and G2 are arranged at equal intervals in the sub-scanning direction, deviation amounts of image forming positions in the main scanning direction at each position on the belt 31 can be detected uniformly.

(4) The belt 31 does not necessarily always move circularly in a stable condition, and a moving condition such as moving speed and a degree of meandering can change depending on timing. Accordingly, it is preferable that the units of the sub-scanning direction marks M and the units of the main scanning direction marks N be formed on the belt 31 at as close timing as possible. In the present embodiment, in the calibration pattern 131, the average position in the sub-scanning and main scanning directions of all the units of the sub-scanning direction marks M in the groups G1 and G2 is identical to the average position in the sub-scanning and main scanning directions of all the units of the main scanning direction marks N in the groups G1 and G2. Accordingly, it can be considered that deviation amounts of image forming positions are detected at approximately the same timing based on the units of the sub-scanning direction marks M and on the units of the main scanning direction marks N. Hence, deviation amounts of image forming positions can be detected in consideration of changes of moving condition of the belt 31 (irregularities of moving condition) in the sub-scanning direction and in the main scanning direction.

(5) According to the present embodiment, in the calibration pattern 131, the same color marks M and N belonging to the different groups G1 and G2 are arranged at different positions in the sub-scanning direction. Thus, even if a sudden change occurs to a moving amount of the belt 31 at a certain position in the sub-scanning direction, no two marks in the same color do not exist at the certain position (see FIG. 5). Hence, effects on detection of deviation amounts due to sudden changes (disturbances) in the belt movement can be suppressed, in comparison with a conventional image forming apparatus that uses a calibration pattern where two marks in the same color are arranged at each position in the sub-scanning direction on the belt 31. This is because, in the present embodiment, the effects on detection of deviation amounts due to sudden changes can be distributed (divided) to effects on detection of deviation amounts of image forming positions in two different colors. In other words, there arises no problem that such a sudden change has effects on two marks in a certain color arranged at the same position in the sub-scanning direction and that the effects are superimposed on the certain color. Further, because the same color marks M and N in different groups G1 and G2 are arranged at different positions in the sub-scanning direction in the entirety of the calibration pattern 131, the effects due to changes (disturbances) in the belt movement can be suppressed in a large area. Note that, in addition to the belt 31, the photosensitive drum 37 can have sudden changes in rotation, and these changes can affect detection of deviation amounts of image forming positions. The printer 1 of the present embodiment can suppress the effects on detection of deviation amounts due to these sudden changes in the photosensitive drum 37, compared with the conventional image forming apparatus.

Modifications

While the invention has been described in detail with reference to the above aspects thereof, it would be apparent to those skilled in the art that various changes and modifications may be made therein without departing from the scope of the claims.

(1) For example, in the above-described embodiment, the calibration pattern 131 is formed on the belt 31. However, the calibration pattern may be formed on the recording medium 7 (a sheet-like medium such as paper and OHP sheet) which is conveyed by the belt 31. Further, if an image forming apparatus is of an intermediate transfer type having an intermediate transfer belt that directly bears a developer image formed on an image bearing member, the calibration pattern may be formed on the intermediate transfer belt.

(2) In the above-described embodiment, the color laser printer 1 of a direct transfer type is described as an example of the image forming apparatus. However, the image forming apparatus of the invention may be applied to a laser printer of an intermediate transfer type, an LED printer, or the like. Further, the image forming apparatus of the invention may be applied to an inkjet type printer. Also, the image forming apparatus may be a printer using colorants (toner, ink, etc.) of two colors, three colors, or five colors or more.

(3) In the above-described embodiment, in the entirety of the calibration pattern 131, the units of the sub-scanning direction marks M and the units of the main scanning direction marks N in different groups G1 and G2 are arranged at the same position in the sub-scanning direction. However, this arrangement may be applied to part of the calibration pattern 131 or may be applied to only certain colors (not all of CMYK colors).

Further, two groups having the same configuration may be arranged to offset from each other in the sub-scanning direction, where the units of the sub-scanning direction marks M and the units of the main scanning direction marks N are alternately arranged in each of the two groups. For example, one of the two groups is offset from the other by a one-unit length. In this calibration pattern, the units of the sub-scanning direction marks M and the units of the main scanning direction marks N in different groups are arranged partly at the same positions in the sub-scanning direction.

(4) In the above-described embodiment, in the entirety of the calibration pattern 131, the same color marks M and N in different groups G1 and G2 are arranged at different positions in the sub-scanning direction. However, this arrangement may be applied to part of the calibration pattern 131 or may be applied to only certain colors (not all of CMYK colors).

Here, an arrangement can be considered, for example, in which marks in the second group G2 are not formed at positions where marks in the first group G1 are formed, and marks in the first group G1 are not formed at positions where marks in the second group G2 are formed. In contrast, in the above-described embodiment (see FIG. 5), at the right side (the opposite side in the main scanning direction) of each mark in the first group G1, a mark in the second group G2 in another color is arranged. With this arrangement, a larger number of marks can be formed on the belt 31, thereby improving accuracy in detecting deviation amounts of image forming positions. Further, timing for forming each of the marks M and N can be managed with a basis of the common time intervals.

What is claimed is:

1. An image forming apparatus comprising:

an image forming section that forms an image on an object;

a controlling section that controls the image forming section to form a calibration pattern on the object, the calibration pattern including a plurality of marks in a first group and a plurality of marks in a second group, the plurality of marks in each of the first group and the second group being arranged in a first direction over a predetermined range, the plurality of marks in each of the first group and the second group including first marks and second marks, the first marks being parallel to a second direction to the first direction and the second marks being non-parallel to the second direction, a position of the first marks in the first group corresponding to a position of the second mark in the second group in the second direction in at least part of the predetermined range, a position of the first marks in the second group corresponding to a position of the second marks in the first group in the second direction in at least part of the predetermined range;

a detecting section that detects the first mark and the second mark formed on the object; and a correcting section that corrects, based on the detected first mark, a deviation in the first direction of an image forming position at which the image forming section forms an image, and corrects, based on the detected second mark, a deviation in the second direction of the image forming position.

2. The image forming apparatus according to claim 1, wherein the first marks in the first group corresponding to the second marks in the second group in the second direction in an entirety of the predetermined range, and the first marks in the second group corresponding to the second marks in the first group in the second direction in the entirety of the predetermined range.

3. The image forming apparatus according to claim 1, wherein the object is movable in the first direction, an average position of the first marks in both the first group and the second group in the part of the predetermined range in the first direction being coincident with an average position of the second marks in both the first group and the second group in the part of the predetermined range in the first direction.

4. The image forming apparatus according to claim 1, wherein the object is movable in the first direction, the second direction being perpendicular to the first direction, an average position of the first marks in both the first group and the second group in the part of the predetermined range in the second direction being coincident with an average position of the second marks in both the first group and the second group in the part of the predetermined range in the second direction.

5. The image forming apparatus according to claim 1, wherein each of the first group and the second group includes a predetermined number of the first marks and the predetermined number of the second marks.

6. The image forming apparatus according to claim 1, wherein a predetermined number of the first marks and a predetermined number of the second marks are arranged alternately in the first direction in each of the first group and the second group.

7. The image forming apparatus according to claim 1, wherein the first marks in each of the first group and the second group are arranged at a predetermined interval in the first direction.

8. The image forming apparatus according to claim 7, wherein the second marks in each of the first group and the second group are arranged at a predetermined interval in the first direction.

9. The image forming apparatus according to claim 1, wherein the object is an endless member having an entire circumferential length, an overall length of the predetermined range in the first direction being equal to or greater than the entire circumferential length.

* * * * *